US006095959A

United States Patent [19]

Negrini et al.

[11] Patent Number: 6,095,959

[45] Date of Patent: Aug. 1, 2000

[54] METHOD AND UNIT FOR FEEDING, IN A PRODUCT WRAPPING MACHINE, A CONTINUOUS BAND OF WRAPPING MATERIAL, THE SURFACE OF WHICH IS PRE-IMPREGNATED WITH AN AROMATIZING SUBSTANCE

[75] Inventors: Fausto Negrini, Castelfranco Emilia; Giuliano Corazza, Casalecchio Di Reno, both of Italy

[73] Assignee: G.D S.p.A., Bologna, Italy

[21] Appl. No.: 09/176,115

[22] Filed: Oct. 21, 1998

[30] Foreign Application Priority Data

Oct. 23, 1997 [IT] Italy ..... BO97A0638

[51] Int. Cl.[7] ..... B31B 1/88

[52] U.S. Cl. ..... 493/58; 53/141; 53/389.4; 53/389.3; 493/327; 493/341; 493/362

[58] Field of Search ..... 53/396, 141, 140, 53/389.4, 389.3, 389.2, 389.1, 393; 493/327, 326, 341, 342, 373, 58, 355, 352, 362, 361, 370, 369; 118/47; 427/358, 356, 385.5, 316, 326; 156/584, 344

[56] References Cited

U.S. PATENT DOCUMENTS

| | | | |
|---|---|---|---|
| 3,668,980 | 6/1972 | Tone | 156/209 |
| 4,010,514 | 3/1977 | Fischer et al. . | |
| 4,103,595 | 8/1978 | Corse | 93/58.3 |
| 4,425,106 | 1/1984 | Boegle et al. | 493/45 |
| 4,601,157 | 7/1986 | Adelman | 53/450 |
| 4,633,650 | 1/1987 | Sohlberg et al. | 53/415 |
| 4,941,376 | 7/1990 | Otsuka | 493/342 |
| 5,226,432 | 7/1993 | Pollentzke et al. | 493/39 |
| 5,618,252 | 4/1997 | Melville | 493/341 |

FOREIGN PATENT DOCUMENTS

| | | |
|---|---|---|
| 2026 375 | 12/1970 | Germany . |
| 1260 118 | 1/1972 | United Kingdom . |

*Primary Examiner*—Stephen F. Gerrity
*Assistant Examiner*—Sam Tawfik
*Attorney, Agent, or Firm*—Pillsbury Madison & Sutro LLP

[57] ABSTRACT

In a method and unit for feeding, in a product wrapping machine, a continuous band of wrapping material, the surface of which is pre-impregnated with an aromatizing substance, the band is unwound from a reel of wrapping material and is fed, along a given path, to a cutting station where the band is cut into lengths, each defining a sheet of wrapping material for a relative product; along the path there is a device for cleaning the band, designed to remove the aromatizing substance from a given portion of the band.

23 Claims, 2 Drawing Sheets

METHOD AND UNIT FOR FEEDING, IN A PRODUCT WRAPPING MACHINE, A CONTINUOUS BAND OF WRAPPING MATERIAL, THE SURFACE OF WHICH IS PRE-IMPREGNATED WITH AN AROMATIZING SUBSTANCE

BACKGROUND OF THE INVENTION

The present invention relates to a method for feeding, in a product wrapping machine, a continuous band of wrapping material, the surface of which is pre-impregnated with an aromatizing substance.

The present invention is advantageously applied in the packaging of packets of items for smokers, to which the following description refers, but without restricting the scope of the invention.

More precisely, the following description refers to the packaging of cigarette packets, although the description is equally valid for the packaging of packets of cigars or other similar items.

Cigarettes fed out of a cigarette-making machine are normally fed into a wrapping machine, in which the cigarettes are arranged in groups, each group being fed to a wrapping line on which they are wrapped first with a sheet of wrapping material, which forms a kind of wrapper, then with a blank (or sheet which forms an outer wrap), which is folded around the wrapper to create a finished packet.

The sheet of wrapping material normally has an aluminum side and a paper side, respectively defining the outer and inner surfaces of the wrapper, and is fed to the wrapping line after being cut from a continuous band at a cutting station, to which the continuous band is fed after being unwound from a reel of wrapping material.

To satisfy the tastes of consumers, cigarettes are known to be aromatized using reels of wrapping material obtained by winding a continuous band whose paper side has been impregnated with the desired aromatizing substance.

Without limiting the general nature of the present description, specific reference is made to the use of menthol aromatizing substances, since these are the most in demand on the market. In particular, such aromatizing substances, normally available in solid form, as powders, are heated until they reach the liquid state, then sprayed onto a given portion of the paper side.

The use of reels of wrapping material obtained in the above-mentioned way allows cigarettes produced by common cigarette-making machines to be aromatized in a very simple, economical way, without damaging them and without necessitating any modifications to said machines. However, such a method causes frequent stoppages on known wrapping machines, since the aromatizing substance tends to stick to and may damage some operating parts of the wrapping machines.

In particular, since the known types of menthol aromatizing substances pass from the solid state to the liquid state at a relatively low temperature (46/48° C. at atmospheric pressure), within the said wrapping machines they assume a semi-solid state which makes the substances particularly sticky and so likely to cause damage.

It should be noticed that during the various wrapping operations, the operating parts, especially the folding means, of the wrapping machines mainly come into contact with the metal side which, although not directly sprayed with the aromatizing substance, is still covered in it because, when the band is wound onto the reel, the two sides of the band make contact with one another.

The use of reels of wrapping material obtained in the above-mentioned way brings further disadvantages if aesthetic requirements necessitate embossing of the band unwound from the reels. Embossing operations of the known type are normally carried out using a pair of embossing rollers, positioned on opposite sides of the band to be embossed, the surfaces of the rollers worked so as to define an embossing die, designed to create a given permanent deformation on the band. Therefore, based on the above information, it is obvious that the aromatizing substance tends to clog the embossing die, compromising its correct functioning.

This disadvantage is normally overcome by heating at least one of the two embossing rollers so that the aromatizing substance in contact with the embossing die is brought to the liquid state. However, such a solution does not solve the basic problem indicated above, since, once the band has been embossed, the aromatizing substance remaining on the band cools and returns to the semi-solid state.

The aim of the present invention is to provide a method for feeding, in a product wrapping machine, a continuous band unwound from a reel obtained in the above-mentioned way, which allows the above-mentioned disadvantages to be at least partially overcome.

SUMMARY OF THE INVENTION

Accordingly, the present invention provides a method for feeding, in a product wrapping machine, a continuous band of wrapping material, the surface of which is pre-impregnat ed with an aromatizing substance. The method includes a stage for unwinding the band from a reel of wrapping material, and a stage for feeding the band to a cutting station, in which the band is cut into lengths, each defining a sheet of wrapping material for a product. The method is characterized in that it includes a stage for cleaning the band, which envisages the removal of the aromatizing substance from a given portion of the band.

The cleaning stage preferably includes an operation in which the aromatizing substance is heated to bring it substantially to the liquid state, an operation in which the aromatizing substance, substantially in the liquid state, is removed from the given portion, and an operation involving the pick up and transfer of the aromatizing substance removed from the given portion.

The present invention also relates to a unit for feeding, in a product wrapping machine, a continuous band of wrapping material, the surface of which is pre-impregnated with an aromatizing substance.

In accordance with the present invention, a unit is provided for feeding, in a product wrapping machine, a continuous band of wrapping material, the surface of which is pre-impregnated with an aromatizing substance. The unit comprises means for unwinding the band from a reel of wrapping material, and means for feeding the band to a cutting station, where it is cut into lengths, each defining a sheet of wrapping material for a product. The unit is characterized in that it comprises means for cleaning the band, designed to remove the aromatizing substance from a given portion of the band.

The cleaning means preferably comprise first heating means which bring the aromatizing substance substantially to the liquid state; removal means for removing the aromatizing substance, substantially in the liquid state, from the given portion; and means for the pick up and transfer of the aromatizing substance removed from the given portion.

BRIEF DESCRIPTION OF THE DRAWINGS

The invention will now be described with reference to the accompanying drawings, which illustrate two embodiments, without limiting the scope of its application, and in which.

DESCRIPTION OF THE PREFERRED EMBODIMENTS

Figure 1:
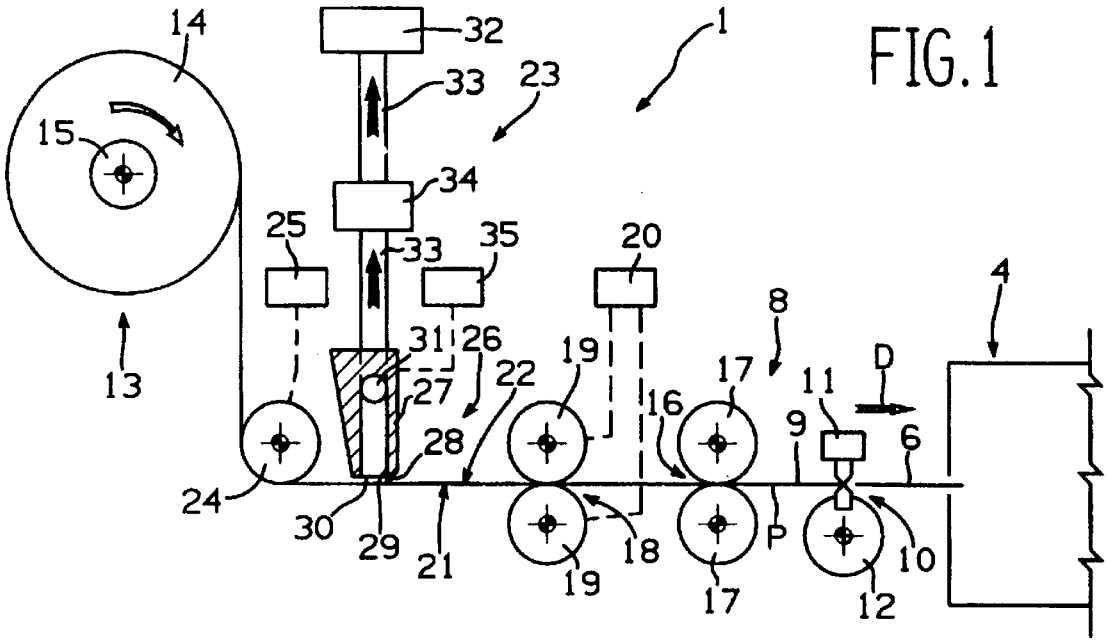
FIG. 1 is a schematic partial block diagram, with some parts cut away for greater clarity, of a portion of a wrapping machine fitted with a preferred embodiment of a feed unit made according to the present invention.
Figure 2:
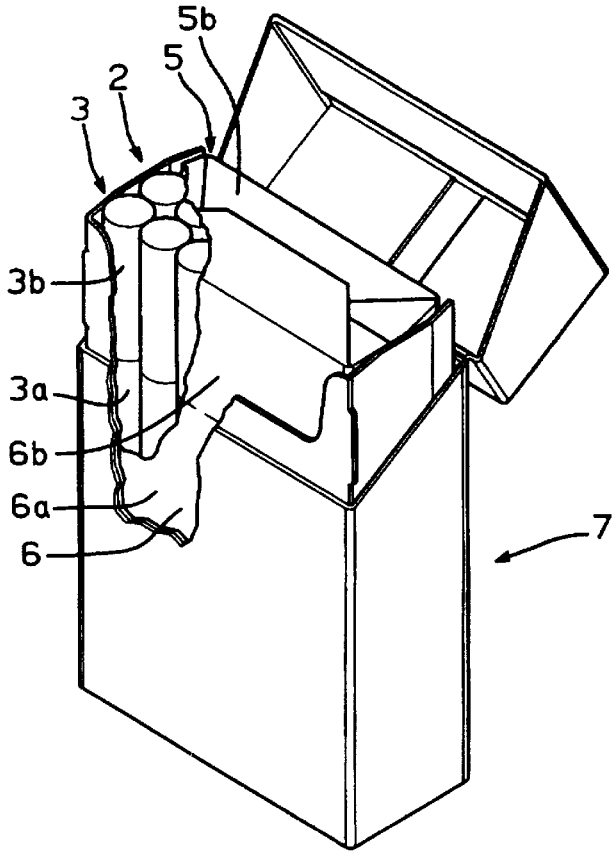
FIG. 2 is a perspective view of a cigarette packet produced by the wrapping machine illustrated in FIG. 1.

With reference to FIGS. 1 and 2, the numeral 1 indicates as a whole a portion of a wrapping machine designed to wrap arranged groups 2 of cigarettes 3, each cigarette comprising a body 3*a* and a filter 3*b*.

The portion 1 comprises at least one wrapping line 4 (of the known type), defining an initial section (known and not illustrated) designed to create a wrapper 5 around each group 2 by wrapping a sheet of wrapping material 6 around the group 2, and an end section (also known and not illustrated) designed to place an outer wrap over each wrapper 5, to create rigid, hinged-lid cigarette packets 7 (FIG. 2) or soft packets (not illustrated).

The line 4 is connected to a unit 8 for feeding a continuous band 9 of wrapping material, and a cutting station 10, located between the unit 8 and the line 4, for cutting the band 9 into constant given lengths, each defining a sheet 6 of wrapping material. In particular, the portion 1 comprises two blades, one fixed 11 and one rotary 12, positioned in the station 10 on opposite sides of the band 9 and designed to operate with one another to cut the band 9 transversally to its longitudinal axis 9*a*; whilst the unit 8, which is also part of the portion 1, extends along a feed path P, between an unwinding station 13, in which, during operation, the band 9 is unwound from a reel 14 supported by a substantially horizontal rotating shaft 15, and a feed device 16 comprising a pair of motor-powered drive rollers 17, which are parallel with one another and substantially horizontal, rotating at the same tangential speed in opposite directions, and positioned on opposite sides of the band 9, so as to feed the band 9 along the path P, longitudinally aligned with a direction D of feed oriented towards the station 10.

The feed unit 8 also comprises an embossing device 18, positioned along the path P between the unwinding station 13 and the feed device 16, in turn comprising a pair of motor-powered metal embossing rollers 19, parallel with one another and substantially horizontal, which are located on opposite sides of the band 9, their surfaces worked so as to define an embossing die (known and not illustrated).

The embossing device 18 also comprises a heating device 20 with temperature regulation (of the known type), designed to heat the two rollers 19 so as to keep the temperature of the surface of the two rollers 19 at a given value (around 50° C.).

Figure 3:
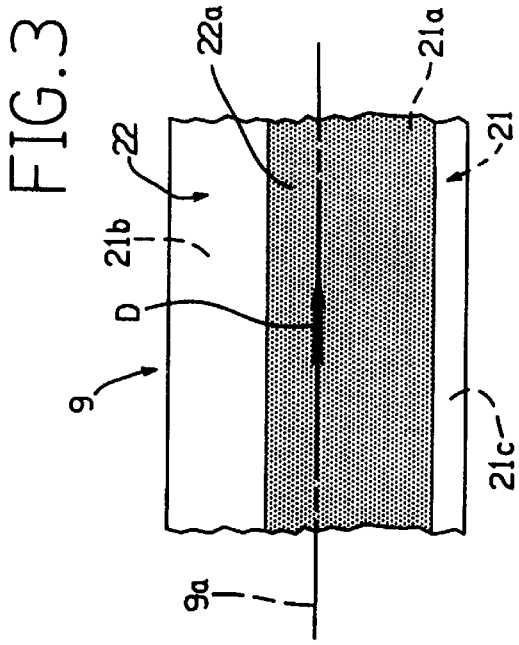
FIG. 3 illustrates a longitudinal portion of a continuous band of wrapping material.

The band 9 has one paper side 21 (the lower side in FIG. 1) and one metal (aluminum) side 22 (the upper side in FIG. 1), which respectively correspond with an inner and outer surface of each of the wrappers 5. The band 9 was wound over itself during production of the reel 14, after being subjected to an aromatizing treatment of the known type, consisting in spraying a menthol aromatizing substance onto a central longitudinal strip 21*a* of the paper side 21 (FIG. 3). In particular, the width of the strip 21*a* is equal to the length of the cigarette bodies 3*a*, so that each sheet of wrapping material 6 has a corresponding aromatized central portion 6*a*, designed to wrap around the relative cigarette bodies 3*a* to aromatize the tobacco contained in them (FIG. 2), and on the side 21 defines two lateral longitudinal strips 21*b* and 21*c* which, for each sheet of wrapping material 6, correspond with two non-aromatized end lateral portions, one of which (not illustrated) is designed to define a base (not illustrated) of the relative wrapper 5, whilst the other, labeled 6*b* in FIG. 2, is designed both to wrap the filters 3*b* and to define the top 5*b* of the wrapper 5.

When, during production of the reel 14, during winding, the paper side 21 of the band 9 is brought into contact with the metal side 22, being lain over the side 22, the latter is unintentionally covered with the aromatizing substance by the strip 21*a* along a corresponding strip 22*a* (FIG. 3). The feed unit 8 comprises a device 23 for cleaning the metal side 22, located along the path P between the unwinding station 13 and the embossing device 18.

The cleaning device 23 comprises a metal idle roller 24 which is substantially horizontal and positioned in contact with the metal side 22 of the band 9, and a heating device 25 with temperature regulation (of the known type) designed to heat the roller 24 so that the temperature of the surface of the roller 24 is kept at a given value (around 50° C.).

The cleaning device 23 also comprises a scraping device 26, located in a fixed position immediately downstream of the roller 24 in direction D and on the same side of the band 9 as the roller 24, for removing the above-mentioned menthol aromatizing substance from the strip 22*a* on the metal side 22.

The scraping device 26 is defined by a metal body 27 with a sharp outer scraping edge 28, which extends from one edge of the band 9 to the other in a direction substantially at right-angles to the direction D and, during operation, makes contact with the metal side 22 of the band 9.

The body 27 has an internal cavity 29, which has an opening 30 towards the metal side 22 and an opening 31 pneumatically connected to an extractor device 32 which is also part of the cleaning device 23. In particular, the opening 30 is located immediately upstream of the edge 28, in the direction D, and extends longitudinally alongside the edge 28 near the side 22; whilst the opening 31 is connected to the device 32 by an extractor pipe 33 which extends through a filter 34.

Finally, the cleaning device 23 also comprises a heating device 35 with temperature regulation (of the known type), designed to heat the body 27 so that the temperature of the edge 28 is kept at a given value (around 50° C.).

During operation, the band 9 is unwound from the reel 14 and fed by the feed device 16 along the path P, towards the line 4 and through the cutting station 10, in which the band 9 is cut into lengths, each defining a sheet of wrapping material 6.

Along the path P, the band 9 passes through the device 23 which cleans the metal side 22, then is embossed (in the known way) by the two rollers 19, the surface temperature of which is kept at a value of around 50° C. by the heating device 20, so that the aromatizing substance on the paper side 21 is in the liquid state at the embossing die, allowing, as indicated above, a correct embossing operation.

As it passes through the cleaning device 23, the band. 9 is first heated by the roller 24, which brings the local temperature of the band 9 to a value (around 50° C.) sufficient to liquefy the aromatizing substance on the side 22. The metal side 22 of the band 9 then makes contact with the edge 28. The edge 28, whose temperature (around 50° C.) is determined by the heating device 35, removes the aromatizing substance in the liquid state from the side 22. The aromatizing substance removed by the edge 28 is then immediately extracted by the extractor device 32 through the cavity 29, the pipe 33 and the filter 34, inside which the aromatizing substance is deposited and solidifies.

Figure 4:
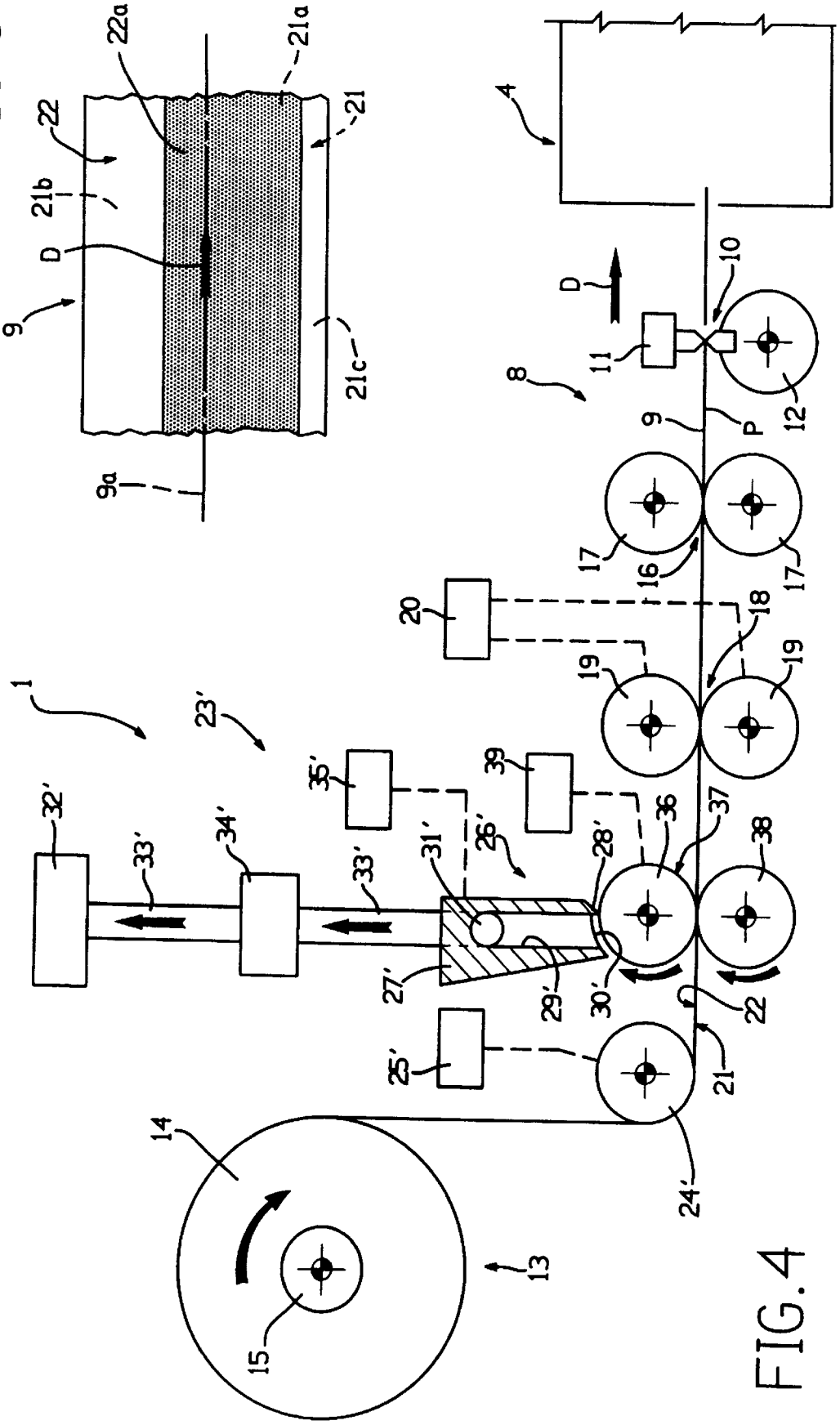
FIG. 4 illustrates another embodiment of the wrapping machine feed unit illustrated in FIG. 1.

FIG. 4 illustrates another embodiment of the cleaning device described above with reference to FIG. 1. For this reason, and for obvious purposes of clarity, the numerals used to label parts in FIG. 4 are the same as in FIG. 1, with the exception of those relative to the cleaning device.

The cleaning device in FIG. 4, labeled 23' as a whole, comprises a metal idle roller 24', which is substantially horizontal and positioned so that it is in contact with the metal side 22 of the band 9, and a heating device 25' with temperature regulation (of the known type), designed to heat the roller 24' so that the temperature of the surface of the roller 24' is kept at a given value (around 50° C.).

The cleaning device 23' also comprises a metal scraping roller 36, positioned parallel with the roller 24' close to and downstream of the roller 24' in the same direction D of feed as that of the band 9, and externally limited by a cylindrical surface 37 which touches the metal side 22. The roller 36 is motor-powered so that it rotates axially in a direction (clockwise in FIG. 4) which allows it to transmit to the surface 37 a sliding motion over the metal side 22 in a direction opposite to direction D, and is designed to co-operate with a counter-roller 38, located opposite the roller 36 on the other side of the band 9 and motor-powered so as to rotate axially in the same direction as the roller 36.

The cleaning device 23' also comprises a heating device 39 with temperature regulation (of the known type), designed to heat the roller 36 so that the temperature of the surface 37 is kept at a given value (around 50° C.).

The cleaning device 23' also comprises a scraping device 26', located in a fixed position on the side of the roller 36 opposite the band 9 and in contact with the surface 37 of the roller 36.

The scraping device 26' is defined by a metal body 27', which has a sharp outer scraping edge 28' that extends, in contact with the surface 37, along a generatrix of the surface 37 on the side opposite the band 9. The body 27' also has an internal cavity 29', which has an opening 30' towards the surface 37 and an opening 31' pneumatically connected to an extractor device 32' which is also part of the cleaning device 23'. In particular, the opening 30' is located immediately upstream of the edge 28', relative to the direction of rotation of the roller 36, and extends longitudinally alongside the edge 28 close to the surface 37; whilst the opening 31' is connected to the device 32' by an extractor pipe 33' which extends through a filter 34'.

Finally, the cleaning device 23' comprises a heating device 35' with temperature regulation (of the known type), designed to heat the body 27' so that the temperature of the edge 28' is kept at a given value (around 50° C.).

During operation, as it passes through the cleaning device 23', the band 9 is first heated by the roller 24', which brings the local temperature of the band 9 to a value (around 50° C.) sufficient to liquefy the aromatizing substance on the side 22. The band 9 is then fed between the roller 36 and the counter-roller 38. The rotation of the roller 36 causes the surface 37 to scrape the metal side 22 and the consequent removal of the aromatizing substance, which is still in the liquid state due to the proximity of the roller 24' and the roller 36.

The aromatizing substance removed from the metal side 22 remains in the liquid state on the surface 37, whose temperature (around 50° C.) is determined by the heating device 39, until it reaches the edge 28'.

The edge 28', whose temperature (around 50° C.) is determined by the heating device 35', then removes the aromatizing substance from the surface 37, still keeping the aromatizing substance in the liquid state.

Finally, the aromatizing substance is immediately extracted by the extractor device 32' through the cavity 29', the pipe 33' and the filter 34', inside which the aromatizing substance is deposited and solidifies.

What is claimed:

1. A method for feeding, in a product wrapping machine, a continuous band of wrapping material, the surface of which is pre-impregnated with an aromatizing substance, comprising:

unwinding the band from a reel of wrapping material;

cleaning the band by removing the aromatizing substance from a selected portion of the band;

feeding the cleaned band towards a cutting station;

cutting the cleaned band into predetermined lengths; and embossing the band;

wherein the cleaning precedes the embossing.

2. An apparatus for feeding, in a product wrapping machine, a continuous band of wrapping material, the surface of which is pre-impregnated with an aromatizing substances comprising:

an unwinding apparatus to unwind the band from a reel of wrapping material;

a feeder to feed the band to a cutting station, the cutting station adapted to cutting the band into lengths; and a band cleaner comprising:

heater to heat the aromatizing substance substantially to the liquid state, a substance removing apparatus to remove the substantially liquid aromatizing substance from a selected portion of the band, and a disposer to transfer the removed aromatizing substance from the vicinity of the band cleaner.

3. The apparatus according to claim 2, wherein the heater comprises a heated element, said element being at least partially in contact with the band, and being designed to transfer heat to the band.

4. The unit according to claim 3, wherein the heated element is defined by an idle roller for the band; at least the surface of said roller consisting of a material which conducts heat.

5. The apparatus according to claim 2, wherein the disposer comprises an extractor device which transfers the removed aromatizing substance from the vicinity of the band cleaner by pneumatic pressure.

6. The apparatus according to claim 2, wherein the substance removing apparatus comprises a first scraper to scrape the substantially liquid aromatizing substance from the selected portion of the band.

7. The apparatus according to claim 6, wherein the first scraper comprises a sharp scraping edge, said edge being in contact with the band at least at the selected portion.

8. The apparatus according to claim 7, wherein the first scraper comprises a material which conducts heat, at least at the scraping edge thereof, and wherein a second heater is disposed to maintain the scraping edge at a given temperature.

9. The apparatus according to claim 7, wherein the disposer is designed to co-operate with the first scraper, picking up, through a passageway provided through a given portion of the first scraper, the aromatizing substance removed from the selected portion of the band.

10. The apparatus according to claim 6, wherein the first scraper comprises a scraping roller, said roller being in contact with the band at least at the selected portion.

11. The apparatus according to claim 10, wherein at least a surface of the scraping roller comprises a material that conducts heat, and wherein a second heater is disposed to maintain the surface of the roller at a given temperature.

12. The apparatus according to claim 10, wherein the disposer comprises a second scraper having a sharp scraping edge positioned in contact with the roller.

13. The apparatus according to claim 12, wherein the second scraper, at least at the sharp scraping edge, comprises a material which conducts heat, and wherein a third heater is disposed to maintain the sharp scraping edge at a given temperature.

14. The apparatus according to claim 12, wherein the disposer is adapted to co-operate with the second scraper, picking up, through a passageway provided through a given portion of the second scraper, the aomatizing substance removed by the second scraper.

15. An apparatus for feeding, in a product wrapping machine, a continuous band of wrapping material, the surface of which is pre-impregnated with an aromatizing substance, comprising:

an unwinding apparatus to unwind the band from a reel of wrapping material;

a feeder to feed the band to a cutting station, the cutting station adapted to cutting the band into lengths;

a band cleaner; and an embosser, located downstream of the bad cleaner in a given direction of feed of the cleaned band.

16. A method for feeding, in a product wrapping machine, a continuous band of wrapping material, the surface of which is pre-impregnated with an aromatizing substance, comprising, in the following order:

unwinding the band from a reel of wrapping material;

cleaning the band by removing the aromatizing substance from a selected portion of the band;

feeding the band towards a cutting station; and cutting the band into predetermined lengths.

17. The method according to claim 16, wherein the band has a paper side and a metal side; the given portion being on the metal side.

18. A method for feeding, in a product wrapping machine, a continuous band of wrapping material, the surface of which is pre-impregnated with an aromatizing substance, comprising:

unwinding the band from a reel of wrapping material;

heating the aromatizing substance such that the aromatizing substance is substantially in the liquid state;

removing the aromatizing substance from a selected portion of the band;

disposing of the removed aromatizing substance by transferring the removed aromatizing substance away from an area where the removal takes place;

feeding the band towards a cutting station; and cutting the band into predetermined lengths.

19. The method according to claim 18, wherein the heating operation is substantially effected by heat conduction.

20. The method according to claim 18, wherein the removal operation is substantially an operation involving the scraping of the given portion.

21. The method according to claim 18, wherein the pick up and transfer operation comprises a stage involving the extraction of the aromatizing substance removed from the given portion.

22. An apparatus for feeding, in a product wrapping machine, a continuous band of wrapping material, the surface of which is pre-impregnated with an aromatizing substance, comprising:

an unwinding apparatus to unwind the band from a reel of wrapping material;

a feeder to feed the band to a cutting station, the cutting station adapted to cutting the band into lengths; and a band cleaner to remove the aromatizing substance from a selected portion of the band, the band cleaner disposed upstream of the feeder in the direction of feed of the band.

23. The apparatus according to claim 22, wherein the band has a paper side and a metal side; said selected portion of the band being on the metal side.

* * * * *